US005331791A

United States Patent [19]

Fux et al.

[11] Patent Number: 5,331,791

[45] Date of Patent: Jul. 26, 1994

[54] METHOD AND APPARATUS FOR THE MANUFACTURE OF A RESEALABLE PACKAGE

[75] Inventors: Rudolf Fux, Eschenburg; Alfred Schmeck, Biedenkopf, both of Fed. Rep. of Germany

[73] Assignee: Kraemer + Grebe GmbH & Co. KG Maschinenfabrik, Biedenkopf-Wallau, Fed. Rep. of Germany

[21] Appl. No.: 966,135

[22] Filed: Oct. 23, 1992

[30] Foreign Application Priority Data

Apr. 4, 1992 [DE] Fed. Rep. of Germany ..... 4211333

[51] Int. Cl.[5] ..... B65B 7/28; B65B 51/00; B65B 51/20

[52] U.S. Cl. ..... 53/478; 53/373.7; 53/374.2

[58] Field of Search ..... 53/476, 478, 329, 329.2, 53/329.3, 373.2, 373.7, 374.2, 375.6

[56] References Cited

U.S. PATENT DOCUMENTS

| | | | |
|---|---|---|---|
| 2,918,767 | 12/1959 | Grinstead et al. | 53/329.3 X |
| 3,198,683 | 8/1965 | Lee | 53/329.3 X |
| 3,720,038 | 3/1973 | Bryan, Jr. et al. | 53/329.3 X |
| 3,760,563 | 9/1973 | Zimmermann | 53/329.3 |
| 4,707,213 | 11/1987 | Mohr et al. | 53/329 X |
| 4,870,800 | 10/1989 | Kasai | 53/329.3 X |
| 5,010,714 | 4/1991 | Medwed et al. | 53/373.7 |
| 5,031,383 | 7/1991 | Hustad | 53/478 X |
| 5,044,145 | 9/1991 | Brembilla | 53/478 |
| 5,163,269 | 11/1992 | Williams | 53/478 X |

FOREIGN PATENT DOCUMENTS 0434447 6/1991 European Pat. Off. .

*Primary Examiner*—Horace M. Culver
*Attorney, Agent, or Firm*—Flynn, Thiel, Boutell & Tanis

[57] ABSTRACT

It is often desired to again seal packages, consisting initially of foils hot-sealed with one another, after opening and partial removal of the content in the package in order to at least partially separate the remaining content in the package from the environment. A resealing area is provided for this purpose besides the hot-sealing area, with which the top and the bottom foil are connected to one another, which resealing area consists of individual closing elements which, fitting into each other, are provided in the two foils. The foils are not threadlike connected with one another in the resealing area. Rather dotlike closing elements exist, which also permit a small undercut. They are formed in matrixes without a top die, which matrixes are thereby subjected to an underpressure, whereas the other side of the foil is under an excess pressure. The deformation is thus brought about purely pneumatically. The shape of the closing elements can in this manner be designed in many ways and can be easily adapted to the requirements of each individual package.

17 Claims, 3 Drawing Sheets

METHOD AND APPARATUS FOR THE MANUFACTURE OF A RESEALABLE PACKAGE

FIELD OF THE INVENTION

The invention relates to a method and an apparatus for the manufacture of a, if necessary, resealable package having a top and bottom foil which can be hot-sealed with one another, and a packaging material to be arranged therebetween, with a resealing area being provided on the package, which area consists of a plurality of closing elements which are complementary to one another and are formed into the top foil and the bottom foil resting on the top foil.

BACKGROUND OF THE INVENTION

For packages, which consist of two foils which are either hot-sealable with one another or are not capable of being sealed, it is often desired that they can be closed again after opening so that the not-used material in the package is not directly exposed to the environment, for example in a refrigerator. A complete seal is thereby not intended, which seal could only be accomplished by a renewed hot sealing; rather only the top and the bottom foil are to be mechanically connected with one another.

Such a resealable package is already known. One of the four sides of a rectangular package is thereby designed as a resealing area such that next to the hot-sealing area is provided a raised sealing bar embossed into the top or bottom foil. The sealing bar can be pressed into a sealing groove embossed into the other foil for the purpose of resealing. The cross section of the sealing bar is thereby slightly larger than the cross section of the sealing groove so that indeed a mechanical clamping of the top with the bottom foil is possible.

Such a resealing area requires that the sealing bar be pressed into the sealing groove precisely starting at one point and is thereafter connected over the entire length to the sealing groove. It requires some manual skill to first create the start of the reseal; however, also its further construction is not reliable because it is easily possible for the sealing bar to get next to the sealing groove. At any rate, to create the reseal is complicated and time consuming.

Therefore, the basic purpose of the invention is to provide a resealable package through a suitable method such that the top foil can be completely separated from the bottom foil during an opening of the package without complicating the subsequent reseal. This reseal is in addition supposed to be created very quickly without requiring special manual skills. The package is thereby supposed to be able to be manufactured within the scope of a packaging line.

SUMMARY OF THE INVENTION

The purpose is attained according to the invention initially by a method in which the resealing area is clamped such that it is sealed off against the surroundings, the resealing area being pulled by atmospheric underpressure against a stationary heating element, the resealing area being heated up by the heating element to a temperature at which it is easily plasticized, and the resealing area being pressed through atmospheric excess pressure away from the heating element and/or being pressed by moving the heating element, into matrixlike recesses in a counterpiece, with the recesses being cooled and evacuated at the same time to thus form the closing elements.

A knub provided on the bottom foil can be formed according to the invention either together with a knub on the top foil or, however, separate therefrom. The knub on the bottom foil is perforated so that no air is entrapped between the knubs of the top and bottom foil during closing. The knubs permit the use also of adhesive foils, which otherwise would only adhere lightly. These foils can be manufactured as monofoils and can be fully recycled as such.

The invention is furthermore characterized by an apparatus to carry out the method in which, following the sealing station in the packaging line, a forming tool is provided in a conveying direction, the forming tool consisting of first and second parts and at least the resealing area being clamped between two opposing pressure surfaces on the forming tool. The first part, starting out from its pressure surface, being provided with a through recess above the resealing area, in which recess the heating element is provided, this recess having an outlet duct connected alternately to an underpressure or excess pressure source. The second part, starting out from its pressure surface, having matrixlike recesses conforming in size and spacing to the closing elements. The second part has a flow channel for cooling medium, and the matrixlike recesses are therein provided with connecting bores, which can be connected to an underpressure source through an outlet duct.

The resealable package, which can be manufactured according to the invention, makes it possible after the removal of a portion of the goods from the package to relatively sturdily connect the top with the bottom foil without requiring a threading of the closing elements. By suitably forming these closing elements, an approximate congruence of the top with the bottom foil is sufficient in order to connect them relatively strongly with one another. Because of the relatively high plasticity of the packaging material, it does not matter in particular in the case of rectangular packages whether the top foil is thereby rotated at 180° with respect to the bottom foil, assuming that the number, the position and the shape of the closing elements correspond on both longitudinal and transverse sides. It has been proven that a repeated resealing is possible without influencing its mechanical strength.

The method permits a designing of the closing elements very variably and to adapt these to the respective package. They can, for example, also be undercut to achieve a very solid reseal. Their formation, without the use of a pressure stamp, by a gaseous pressure means easily allows such a structural design. Furthermore, to forego moving parts enhances the life of the work station. The cooling of the matrixlike recesses assures that the closing elements very quickly lose their plasticity and can be released easily and without further changes in form.

BRIEF DESCRIPTION OF THE DRAWINGS

The invention will be described in greater detail hereinafter in connection with an exemplary embodiment and the drawings, in which.

DETAILED DESCRIPTION

Figure 1:
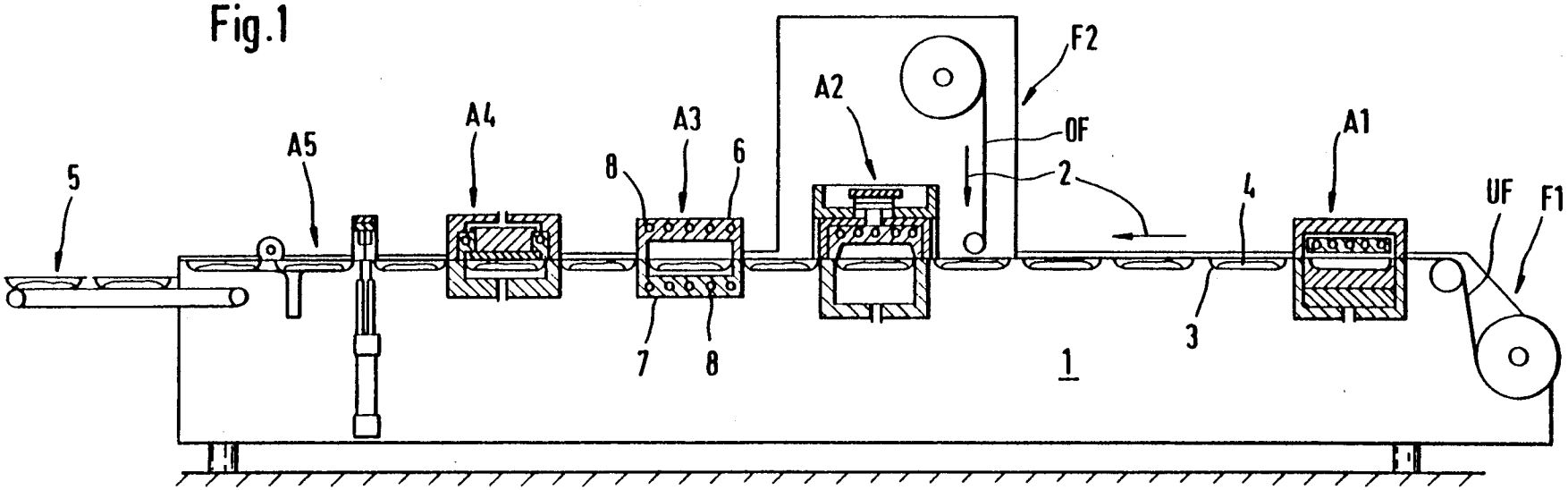
FIG. 1 schematically illustrates an overview of a packaging line with an apparatus embodying the invention.

FIG. 1 illustrates, in a very simplified manner, a packaging line which is equipped with suitable operating means to carry out the method of the invention. A frame 1 includes two conveyor devices F1 and F2 to introduce the bottom foil UF utilizing a conveyor device F1 and the top foil OF utilizing a conveyor device F2. The conveying directions are shown by arrows 2. The bottom foil UF is first shaped in a work station A1 so that a storage space 3, which can be filled with a material 4 to be packaged, is created in the bottom foil UF. The top foil OF is supplied in a following hot-sealing tool A2, is placed onto the bottom foil UF and is sealed to same. A preheating tool A3 follows downstream thereafter in conveying direction followed by a forming tool A4 in which a resealing area or resealable portion 51 is created. The separation of the individual packages 5 by longitudinal and cross-cutting devices finally takes place in a work station A5.

Figure 3:
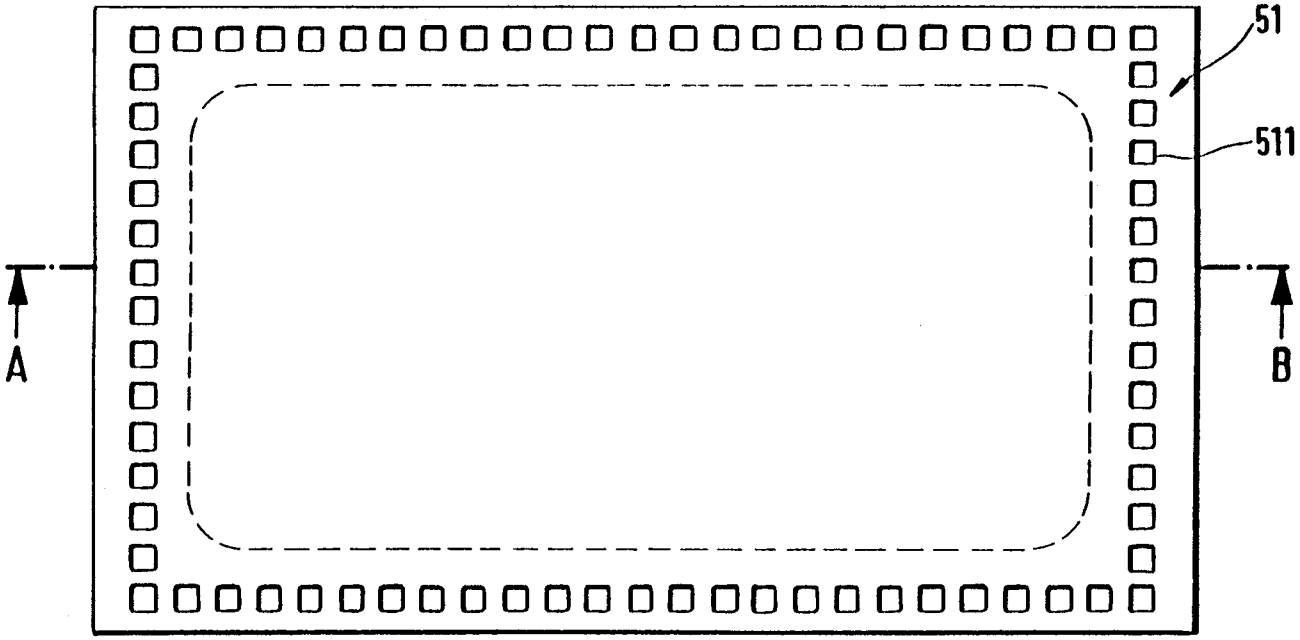
FIG. 3 schematically illustrates a package produced according to the method of the invention on a packaging line according to FIG. 1.

The preheating tool A3 consisting of an upper part 6 and a lower part 7 has a heater 8, with the help of which the entire resealing area 51 is heated (FIG. 3). The resealing area is heated directly by the surfaces of the upper part 6 and of the lower part 7, which surfaces abut one another under contact pressure to clamp the resealing area therebetween. The resealing area 51 accompanying the hot-sealing areas existing on the package 5 is advantageously preheated to a temperature which lies just below the temperature necessary for a plastification of the foils of OF and UF.

Figure 2:
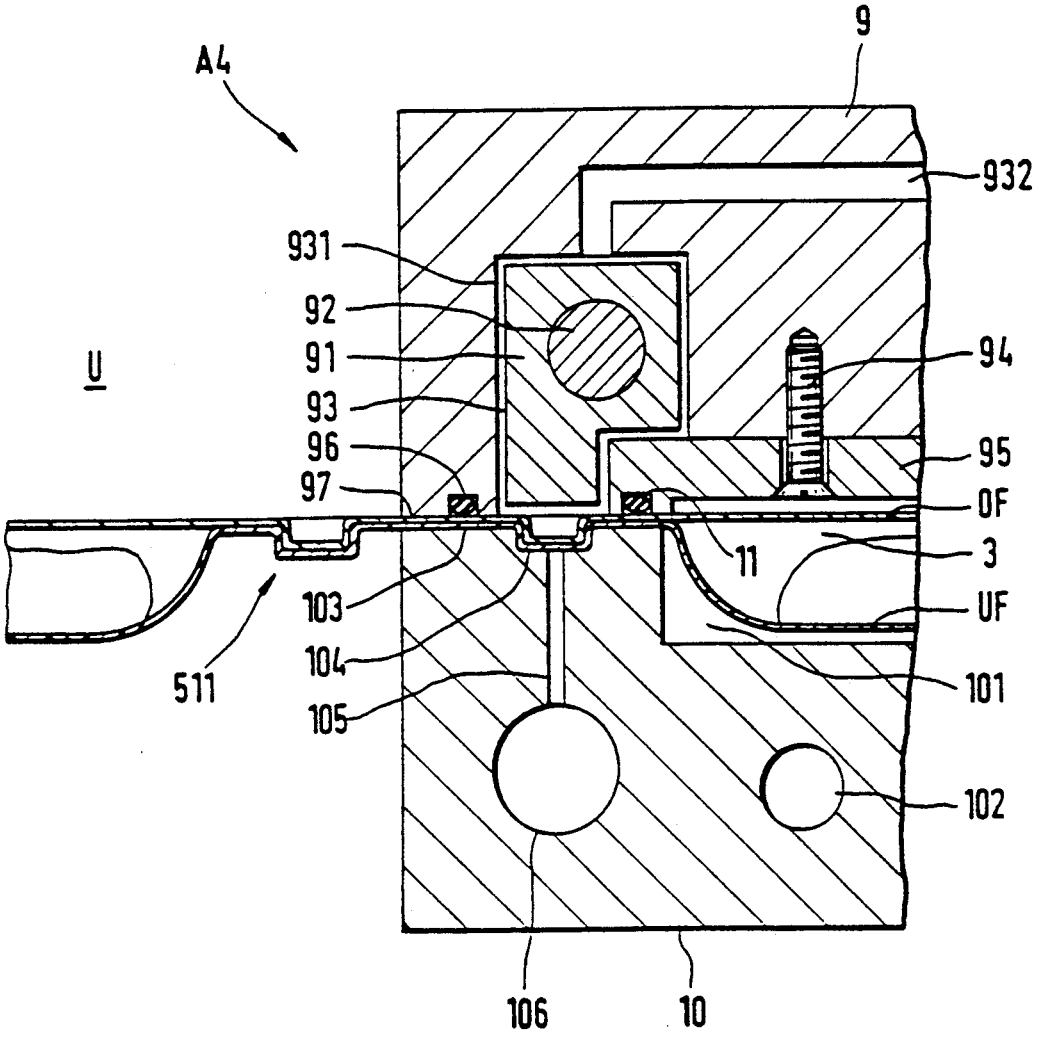
FIG. 2 schematically illustrates in an enlarged scale a work station A4 of FIG. 1.

The forming tool A4 following downstream in conveying direction is illustrated in detail in FIG. 2. It too is divided into two parts and consists of an upper part 9 and a lower part 10. It is to be understood that the divided tools 6, 7 and 9, 10 are movable vertically relative to one another; it is common for the lower part 7 or 10 to be designed so that it can be lowered. The lower part 10 has a receiving means 101 into which is received the storage space 3 in the lower foil. A flow channel 102 in the lower part 10 is used to cool the lower part 10. A plurality of recesses 104 are provided in a pressure surface 103 of the lower part 10, which recesses are each connected to an outlet passageway 106 by means of a connecting bore 105, which outlet passageway 106 in turn is connected to an underpressure source so that the recesses 104 can be evacuated. Each recess 104 represents a matrix for a closing or closure element 511, with the entirety of all closing elements 511 representing the resealing area 51. The shape of the recesses 104 determines thereby also the shape of the closing elements 511. FIG. 3 shows that they are closing elements 511 ("knubs"), which are square in cross section and rectangular in longitudinal cross section.

The upper part 9 has a heating element 91 which can be heated by electrical heating cartridges 92 and is stored with only little movement in a through recess 93. A cover plate 95 fastened with screws 94 to the upper part 9 locks the heating element 91 to the upper part 9. A significant space is provided between the heating element 91 and an interior wall 931 of the recess 93, which space facilitates a pneumatic connection between an outlet passageway 932 and a gap directly above the top foil OF sealed to the bottom foil UF, which gap is also directly above the recess 104 of the lower part 10. The gap, which is pneumatically isolated from the surroundings U by seals 11 provided in grooves 96, is associated with the resealing area 51. The seals 11 can be any type of sealing material such as gasket cord.

Figure 5:
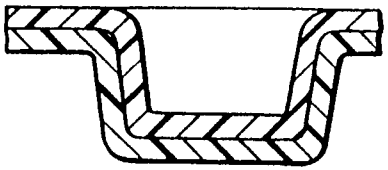
FIG. 5 schematically illustrates again in an enlarged scale a detail X of FIG. 4.
Figure 4:
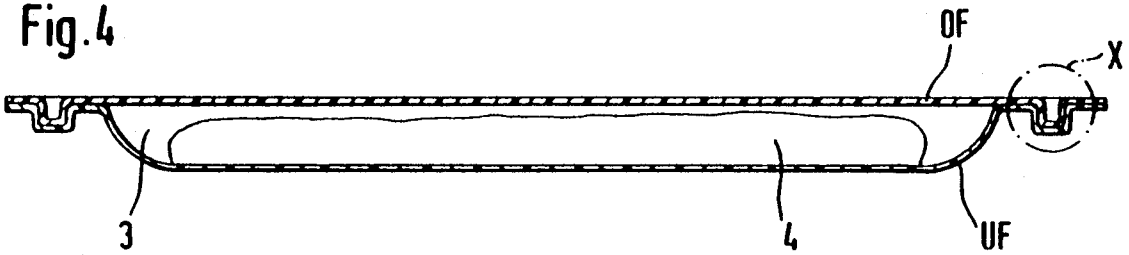
FIG. 4 is a schematic cross-sectional view A–B of FIG. 3.

FIGS. 3 to 5 illustrate in detail a finished package 5 already equipped with a resealing area 51. The top foil OF, or the bottom foil UF, which are hot-sealed with one another and enclose the material 4 to be packaged airtight in the storage space 3, are already cut to size with respect to length and width. The resealing area 511 exists here on all sides and consists of a plurality of closing elements 511 which can be easily recognized as having a cup-like cross-section in FIG. 5. It is to be understood that the shape of the closing elements 511 can be practically as desired. They are shown in the drawing with a slight releasing slope for facilitating a comfortable release from the recesses 104. However, it is also easily possible to design the closing elements 511 with an undercut, just like their cross section (in the top view of FIG. 3), a circular cross-section (not shown), or can be designed as desired. The bottom area of each knub or closing element formed in the bottom foil is perforated so that no air is entrapped between the knubs of the top and bottom foil during closing. The perforations are formed in the bottom foil prior to supplying the top foil.

After the not-yet-cut packages 5 have left the heat-sealing tool A2 and have reached the preheating tool A3, they are preheated here in order to be able to utilize the time available in the next following forming tool A4 exclusively for the manufacture of the closing elements 511. The preheating task effects a heating up to a temperature in which the foils OF and UF are just not yet plastically formable. The already preheated package 5 is subsequently moved into the forming tool A4. The resealing area 51 is clamped between the divided tools 9 and 10, particularly the pressure surfaces 97 and 103, thereon to cause the storage space 3 to be pneumatically insulated or hermetically isolated from the surroundings U by the seal 11. The outlet passageway 932 is subsequently connected to an underpressure source so that the top foil OF (with the bottom foil UF sealed thereon) rests on the heating element 91 between the two seals 11. The two adjoining foils OF and UF are heated up further with the help of the heater 92 so that they can be plastically deformed. The outlet passageway 932 is subsequently connected to an excess pressure source, with the help of which the foils OF and UF are pressed in the area of the recesses 104 in the lower part 10 into the recesses. The recesses 104 are at the same 10 time evacuated with the help of an underpressure source acting through the outlet passageway 106 and the deformation of the foils OF and UF is thus supported. The closing elements 511 are created in this manner. The lower part 10 is during this time cooled so much with the help of the cooling medium flowing through the flow channel 102 that the foils OF and UF quickly lose their plasticity in the recess 104 when they come into contact with its wall. They keep then merely a certain residual elasticity which is sufficient to overcome, for example, an undercut provided in the recess 104. The package 5 completed in this manner is thereafter separated in the work station A5; the now complete packages 5 are removed from the area of the packaging machine by a conveyor belt.

The embodiments of the invention in which an exclusive property or privilege is claimed are defined as follows:

1. A method of manufacturing a resealable package having a top foil and a bottom foil which are hot-sealed together at a peripheral edge of the package to form a resealable portion and to seal a packaging material arranged therebetween, the resealable portion having a plurality of pairs of complementary mateable closure elements formed into the peripheral edge of the top foil and the bottom foil, the method comprising the steps of:

clamping the resealable portion at the peripheral edge thereof between a first member and a second member of a forming tool to hermetically isolate the resealable portion from an outer surroundings;

drawing a first surface of at least one of the top and bottom foils of the resealable portion against a plurality of stationary heating elements of said first member by negative pressure, heating a plurality of areas of the resealable portion drawn against said heating elements to a temperature at which said areas are plasticized;

separating said areas from said heating elements by applying positive pressure to said first surface of the resealable portion while simultaneously drawing said heated areas into a plurality of opposing recesses in said second member; and cooling and evacuating said recesses to form the closure elements, said recesses being evacuated by applying negative pressure to a second surface of the other of said at least one of the top and bottom foils of the resealable portion.

2. The method according to claim 1, wherein closure elements are formed in the bottom foil, and each closure element is perforated in a bottom area thereof.

3. The method according to claim 2, wherein the closure elements are formed in a work station.

4. The method according to claim 2, wherein the closure elements are perforated prior to a supplying of the top foil.

5. The method according to claim 1, wherein the top foil and the bottom foil are hot-sealed together in an area which coincides with the resealable portion.

6. The method according to claim 1, wherein the resealable portion is preheated in a preheating station prior to performing the clamping step.

7. An apparatus for making a resealable package, the package having a top foil and a bottom foil hot-sealed together at a peripheral edge of the package to form a resealable portion and to seal a packaging material arranged therebetween, the resealable portion having a plurality of pairs of complementary mateable closure elements formed into the peripheral edge of the top foil and the bottom foil, the apparatus comprising:

means for supplying positive or negative air pressure;

a forming tool positioned downstream of a sealing station along a packaging line, the forming tool including first and second parts having first and second opposing pressure surfaces respectively, said pressure surfaces cooperating to relatively movably clamp the resealable portion therebetween along the peripheral edge of the resealable portion;

said first part also having a through recess communicating with the resealable portion, a plurality of heating elements disposed within said through recess, and an outlet passage connecting said through recess to said means for supplying positive or negative pressure;

said second part also having a plurality of matrix-like recesses formed on said second pressure surface and conforming in size and spacing to the closure elements, means for cooling said second part, and a plurality of connecting bores connecting said matrix-like recesses to said means for supplying positive or negative pressure;

whereby said means for supplying positive and negative pressure draws the resealable portion against said heating elements to form plasticized portions of the resealable portion before simultaneously drawing and forcing said plasticized portions from said heating elements into said recesses to form said closure elements.

8. The apparatus according to claim 7, wherein said preheating tool is positioned downstream from a heat-sealing tool along said packaging line, wherein the preheating tool consists of an upper part and a lower part, the resealable portion of the package being clamped between said upper and lower parts and sealed against an outer surroundings, and at least one of the upper part and lower part are heated to preheat the resealable portion.

9. The apparatus according to claim 7, wherein the matrix-like recesses have a cup-like cross-section in a plane transverse to the top and bottom foils.

10. The apparatus according to claim 7, wherein the matrix-like recesses have at least one of a circular and a quadrilateral cross-section in a plane parallel to the top and bottom foils.

11. The apparatus according to claim 7, wherein the connecting bores connect the matrix-like recesses to a second outlet passage, said second outlet passage being connected to the means for supplying positive or negative pressure.

12. The apparatus according to claim 7, wherein said heating elements within said through recess are disposed away from interior walls defining said through recess, said heating elements and said interior walls cooperating to define channels therebetween.

13. The apparatus according to claim 12, wherein said channels are connected to said outlet passage.

14. The apparatus according to claim 7, wherein said heating elements each include a bore adapted to receive an electrical heating cartridge, and wherein said means for cooling said second part includes flow channels proximate to the matrix-like recesses, said flow channels guiding a cooling medium through said second part.

15. The apparatus according to claim 7, wherein at least one of said first and second pressure surfaces includes sealing means for hermetically isolating the resealable portion from an outer surroundings when said first and second surfaces relatively movably clamp the resealable portion therebetween.

16. The apparatus according to claim 15, wherein the sealing means includes a groove having a gasket cord arranged therein.

17. The apparatus according to claim 7, wherein the first part is an upper part of the forming tool, and the second part is a mating lower part.

* * * * *